US011077995B2

(12) United States Patent
Pinelli et al.

(10) Patent No.: US 11,077,995 B2
(45) Date of Patent: Aug. 3, 2021

(54) SLIDER LID FOR BEVERAGE CONTAINER

(71) Applicant: Leapfrog Product Development LLC, Chicago, IL (US)

(72) Inventors: Steven N. Pinelli, Ogden Dunes, IN (US); Derek J. Leatzow, Chicago, IL (US); Richard E. Ellison, Chicago, IL (US); Kurtis M. Sward, Anna Maria, FL (US); Micaela K. McCabe, Chicago, IL (US); Glen C. Gilmore, III, Naperville, IL (US); Brian M. Clemens, Burnsville, MN (US)

(73) Assignee: Leapfrog Product Development LLC, Chicago, IL (US)

( * ) Notice: Subject to any disclaimer, the term of this patent is extended or adjusted under 35 U.S.C. 154(b) by 259 days.

(21) Appl. No.: 16/438,678

(22) Filed: Jun. 12, 2019

(65) Prior Publication Data

US 2020/0391910 A1 Dec. 17, 2020

(51) Int. Cl.

| | |
|---|---|
| ***B65D 47/28*** | (2006.01) |
| ***B65D 43/02*** | (2006.01) |
| ***A47G 19/22*** | (2006.01) |

(52) U.S. Cl.

CPC ..... *B65D 47/286* (2013.01); *A47G 19/2272* (2013.01); *B65D 43/0229* (2013.01); *B65D 2543/00046* (2013.01); *B65D 2543/0049* (2013.01); *B65D 2543/00092* (2013.01); *B65D 2543/00231* (2013.01); *B65D 2543/00546* (2013.01)

(58) Field of Classification Search

CPC ..... B65D 47/286; B65D 43/0229; B65D 2543/00546; B65D 2543/00092; B65D 2543/00231; B65D 2543/0049; B65D 2543/00046; A47G 19/2272

USPC ..... 220/254.5, 714, 825

See application file for complete search history.

(56) References Cited

U.S. PATENT DOCUMENTS

| | | | | |
|---|---|---|---|---|
| D364,810 | S | 12/1995 | Meisner | |
| 5,495,966 | A * | 3/1996 | Won | F16K 31/52 222/508 |
| 6,116,476 | A * | 9/2000 | Huang | B65D 47/249 222/506 |
| D471,455 | S | 3/2003 | Laveault et al. | |
| D485,132 | S | 1/2004 | Ohno et al. | |
| D505,294 | S | 5/2005 | Gauss | |
| D508,185 | S | 8/2005 | Gauss | |
| D515,357 | S | 2/2006 | Ward et al. | |
| D528,862 | S | 9/2006 | Li | |

(Continued)

OTHER PUBLICATIONS

Zulu, "Atlas20 oz Glass Water Bottle," accessed on-line at: https://www.zuluathletic.com/shop-all/atlas-glass-water-bottle (available at least as early as Jun. 12, 2019).

(Continued)

*Primary Examiner* — James N Smalley

(74) *Attorney, Agent, or Firm* — Barnes & Thornburg LLP

(57) ABSTRACT

A lid for a beverage container includes a lid housing with a drink opening, a slider member, and a seal assembly. The seal assembly has a seal arm, a seal and a spring. The slider member slides linearly about the lid housing. A cam pivotally connected to the slider member engages the seal arm. The slider member and cam operate to move the seal arm from an open position to a sealed position. The drink opening is open when the seal arm is in the open position, and the drink opening is closed by the seal when the seal arm is in the closed position.

20 Claims, 10 Drawing Sheets

(56) References Cited

U.S. PATENT DOCUMENTS

| | | | | |
|---|---|---|---|---|
| D533,061 | S | 12/2006 | Li | |
| D564,841 | S | 3/2008 | Clemens et al. | |
| D579,722 | S | 11/2008 | Sakulsacha et al. | |
| D581,727 | S | 12/2008 | Pinelli et al. | |
| D592,456 | S | 5/2009 | Pinelli et al. | |
| D592,905 | S | 5/2009 | Pinelli et al. | |
| D592,913 | S | 5/2009 | Pinelli et al. | |
| 7,546,933 | B2 | 6/2009 | Pinelli | |
| D609,964 | S | 2/2010 | Lane | |
| D643,249 | S | 8/2011 | Miller et al. | |
| 7,997,442 | B2 | 8/2011 | Pinelli | |
| D655,580 | S | 3/2012 | Kotani | |
| D656,787 | S | 4/2012 | Phillips et al. | |
| D661,945 | S | 6/2012 | Eyal | |
| D675,060 | S | 1/2013 | Lane | |
| 8,360,267 | B1 | 1/2013 | Chiou et al. | |
| D686,871 | S | 7/2013 | Lane | |
| D693,629 | S | 11/2013 | Miller | |
| D693,630 | S | 11/2013 | Hurley et al. | |
| 8,579,133 | B2 | 11/2013 | Marcus et al. | |
| 8,590,731 | B2 | 11/2013 | Pinelli | |
| D700,012 | S | 2/2014 | Hurley et al. | |
| D700,802 | S | 3/2014 | Miller | |
| 8,978,906 | B2 | 3/2015 | Feeley et al. | |
| D725,966 | S | 4/2015 | Boroski et al. | |
| D739,183 | S | 9/2015 | Lane | |
| 9,266,643 | B2 | 2/2016 | Marcus et al. | |
| D758,189 | S | 6/2016 | Roth et al. | |
| D758,790 | S | 6/2016 | Boroski | |
| 9,462,904 | B2 * | 10/2016 | Coon | B65D 43/265 |
| D780,578 | S | 3/2017 | Lane et al. | |
| D785,402 | S | 5/2017 | Shirley et al. | |
| D793,804 | S | 8/2017 | Herbst et al. | |
| D794,453 | S | 8/2017 | Boroski et al. | |
| D795,011 | S | 8/2017 | Pisarevsky | |
| D799,898 | S | 10/2017 | Yao | |
| D802,993 | S | 11/2017 | Joseph et al. | |
| D804,903 | S | 12/2017 | Mason et al. | |
| D804,904 | S | 12/2017 | Noveletsky et al. | |
| D808,220 | S | 1/2018 | Burns et al. | |
| D809,384 | S | 2/2018 | Best et al. | |
| D814,398 | S | 4/2018 | Yasunaga | |
| D817,713 | S | 5/2018 | Lin | |
| D818,767 | S | 5/2018 | Nezu | |
| D821,136 | S | 6/2018 | Silsby et al. | |
| D821,137 | S | 6/2018 | Boroski | |
| D821,815 | S | 7/2018 | Chung | |
| D822,427 | S | 7/2018 | Sorensen et al. | |
| D831,425 | S | 10/2018 | Best et al. | |
| D831,433 | S | 10/2018 | Fleischhut | |
| D835,939 | S | 12/2018 | Yee et al. | |
| D839,044 | S | 1/2019 | Potter et al. | |
| D848,787 | S | 5/2019 | Tatsukawa et al. | |
| D853,181 | S | 7/2019 | Stanton | |
| D853,784 | S | 7/2019 | Wu | |
| D865,457 | S | 11/2019 | Kotani | |
| D869,230 | S | 12/2019 | Hao | |
| D870,509 | S | 12/2019 | Bo | |
| 2011/0089059 | A1 | 4/2011 | Lane et al. | |
| 2012/0312832 | A1 | 12/2012 | Lane | |
| 2014/0339177 | A1 | 11/2014 | Lane | |
| 2015/0282654 | A1 | 10/2015 | Kurabe et al. | |
| 2015/0344199 | A1 * | 12/2015 | Chiou | B65D 47/20 220/254.7 |
| 2017/0297785 | A1 | 10/2017 | Maruyama et al. | |
| 2020/0055645 | A1 * | 2/2020 | Lane | B65D 51/18 |
| 2020/0231345 | A1 * | 7/2020 | Lane | A47J 41/0027 |
| 2020/0377272 | A1 * | 12/2020 | Ma | A47J 41/0027 |

OTHER PUBLICATIONS

Kor, "Vida Bottle—25oz," accessed on-line at: https://waterbottles.com/kor-vida-bottle-25-oz (available at least as early as Jun. 12, 2019).

Thermos, "Hydration Bottle with Rotating Intake Meter, 24oz," accessed on-line at: https://www.thermos.com/genuine-thermos-brand-hydration-bottle-with-rotating-intake-meter-24oz.html (available at least as early as Jun. 12, 2019).

Thermos, "Shaker Bottle with Integrated Mixer, 24oz," accessed on-line at: https://www.thermos.com/genuine-thermos-brand-shaker-bottle-with-integrated-mixer-24oz-clear-green-accents.html (available at least as early as Jun. 12, 2019).

Tervis, "Custom Water Bottle," accessed on-line at: https://www.tervis.com/turtle-sunset-stainless-steel-24oz-stainless-water-bottle-1362572.html (available at least as early as Jun. 12, 2019).

Swell, "Bottles," accessed on-line at: https://www.swell.com/shop/swell/bottles/ (available at least as early as Jun. 12, 2019).

Tritan, "32 oz Soft Straw Plastic Water Bottle," accessed on-line at: http://www.pogagear.com/32oz-tritan-straw (available at least as early as Jun. 12, 2019).

Tritan, "32oz Chug Plastic Water Bottle," accessed on-line at: http://www.pogogear.com/32oz-tritan-chug (available at least as early as Jun. 12, 2019).

Tritan, "18oz Chug Plastic Water Bottle," accessed on-line at: http://www.pogogear.com/18oz-tritan-chug (available at least as early as Jun. 12, 2019).

Ello, "chi 24oz BPA-Free Tritan Plastic Water Bottle," accessed on-line at: https://www.elloproducts.com/water-bottles/chi-24oz-plastic-water-bottle (available at least as early as Jun. 12, 2019).

Ello, "Dash 16oz 2pk Tritan Plastic Water Bottles," accessed on-line at: https://www.elloproducts.com/kids/dash-16oz-tritan-plastic-water-bottle (available at least as early as Jun. 12, 2019).

Ello, "Cru Stemless Wine glass Set with Silicone Protection," accessed on-line at: https://www.elloproducts.com/tumblers/cru-stemless-wine-glass-set-with-silicone-protection (available at least as early as Jun. 12, 2019).

Aladdin, "Water Bottle," (1 page) (available at least as early as Jun. 12, 2019).

Ello, "Elsie 22oz Glass Water Bottle," accessed on-line at: https://www.elloproducts.com/water-bottles/elsie-22oz-glass-water-bottle (available at least as early as Jun. 12, 2019).

Ello, "Beacon 24oz Vacuum Insulated Stainless Tumbler," accessed on-line at: https://www.elloproducts.com/tumblers/beacon-24oz-vacuum-insulated-stainless-tumbler (available at least as early as Jun. 12, 2019).

Ello, "Rise 12oz Vacuum Insulated Stainless Steel Tumbler with Optional Straw," accessed on-line at: https://www.elloproducts.com/kids/rise-12oz-vacuum-insulated-stainless-steel-tumbler (available at least as early as Jun. 12, 2019).

Ello, "Hammertime 18oz Stainless Steel Travel Mug," accessed on-line at: https://www.elloproducts.com/travel-mugs/hammertime-18oz-vacuum-insulated-stainless-steel-travel-mug (available at least as early as Jun. 12, 2019).

Ello, "Pure 20oz Glass Water Bottle," accessed on-line at: https://www.elloproducts.com/water-bottles/pure-20oz-glass-water-bottle (available at least as early as Jun. 12, 2019).

Ello, "Max 12oz Vacuum-Insulated Stainless Steel Kids Water Bottle," accessed on-line at: https://www.elloproducts.com/kids/max-12oz-vacuum-insulated-stainless-steel-kids-water-bottle (available at least as early as Jun. 12, 2019).

Ello, "Syndicate 20oz Glass Water Bottle," accessed on-line at: https://www.elloproducts.com/water-bottles/syndicate-20oz-glass-water-bottle (available at least as early as Jun. 12, 2019).

Mason, "Glass Jar," (1 page) (available at least as early as Jun. 12, 2019).

Camelbak, "Eddy+ 1L Bottle," accessed on-line at: https://www.camelbak.com/en/bottles/R02056--Eddy_75L_2019?color=6bbd0584f3a64b0eb30d406t7e03797e (available at least as early as Jun. 12, 2019).

Contigo, "Autoseal West Loop 2.0 Stainless," accessed on-line at: https://www.gocontigo.com/20-oz-autoseal-west-loop-stainless-travel-mug-with-easy-clean-lid.html (available at least as early as Jun. 12, 2019).

Contigo, "Autospout Straw Striker Chill," accessed on-line at: https://www.gocontigo.com/14-oz-autospout-striker-kids-water-bottle.html (available at least as early as Jun. 12, 2019).

(56) References Cited

OTHER PUBLICATIONS

Zojirushi, "Travel Mug SM-YAE48," accessed on-line at: https://www.zojirushi.com/app/product/smyae (available at least as early as Jun. 12, 2019).
Zojirushi, "Stainless Mug SM-KC3648," accessed on-line at: https://www.zojirushi.com/app/product/smkc (available at least as early as Jun. 12, 2019).
Zojirushi, "Stainless Bottle SJ-JS10," accessed on-lien at: https://www.zojirushi.com/app/product/sjjs (available at least as early as Jun. 12, 2019).
Zojirushi, "Flip-and-Go Stainless Mug SM-QHE48/60," accessed on-line at: https://www.zojirushi.com/app/product/smqhe (available at least as early as Jun. 12, 2019).
Zojirushi, "Stainless Mug SM-TAE48SA, Ichimatsu Collection," accessed on-line at: https://www.zojirushi.com/app/product/smtae (available at least as early as Jun. 12, 2019).
Zojirushi, "Stainless Mug SM-TA36/48/60," accessed on-line at: https://www.zojirushi.com/app/product/smta (available at least as early as Jun. 12, 2019).
Zojirushi, "Stainless Mug SM-SE36/48/60," accessed on-line at: https://www.zojirushi.com/app/product/smse (available at least as early as Jun. 12, 2019).
Zojirushi, "Stainless Mug SM-SD36/48/60," accessed on-line at: https://www.zojirushi.com/app/product/smsd (available at least as early as Jun. 12, 2019).
Zojirushi, "Stainless Mug SM-SHE48/60," accessed on-line at: https://www.zojirushi.com/app/product/smshe (available at least as early as Jun. 12, 2019).
Zojirushi, "Stainless Mug SM-KHE36/48," accessed on-line at: https://www.zojirushi.com/app/product/smkhe (available at least as early as Jun. 12, 2019).
Zojirushi, "Stainless Mug SM-SC36/48/60" accessed on-line at: https://www.zojirushi.com/app/product/smsc (available at least as early as Jun. 12, 2019).
Zojirushi, "Stainless Mug SM-PC20/30," accessed on-line at: https://www.zojirushi.com/app/product/smpc (available at least as early as Jun. 12, 2019).
Zojirushi, "Stainless Mug SM-PB30/34," accessed on-line at: https://www.zojirushi.com/app/product/smpb (available at least as early as Jun. 12, 2019).
Migo, "Enjoy Sport Water Bottle," accessed on-line at: https://www.pinterest.ru/pin/12666442685646757/ (available at least as early as Jun. 12, 2019).
Coleman, "Switch SS," accessed on-line at: https://www.coleman.com/all-camp-kitchen/drinkware/switch-ss/col_2038485pr/COL_2038485 (available at least as early as Jun. 12, 2019).
Corkcicle, "Classic Arctican," accessed on-line at: https://corkcicle.com/products/classic-arctican?variant=475182759951 (available at least as early as Jun. 12, 2019).
Ello, "Reflext Beverage Container," (1 page) (available at least as early as Jun. 12, 2019).
https://www.zuluathletic.com/shop-all/atlas-glass-water-bottle.
https://waterbottles.com/kor-vida-bottle-25-oz.
https://www.thermos.com/genuine-thermos-brand-hydration-bottle-with-rotating-intake-meter-24oz.html.
https://www.thermos.com/genuine-thermos-brand-shaker-bottle-with-integrated-mixer-24oz-clear-green-accents.html.
https://www.tervis.com/turtle-sunset-stainless-steel-24oz-stainless-water-bottle-1362572.html.
https://www.swell.com/shop/swell/bottles/.
http://www.pogogear.com/32oz-tritan-straw.
http://www.pogogear.com/32oz-tritan-chug.
http://www.pogogear.com/18oz-tritan-chug.
https://www.elloproducts.com/water-bottles/chi-24oz-plastic-water-bottle.
https://www.elloproducts.com/kids/dash-16oz-tritan-plastic-water-bottle.
https://www.elloproducts.com/tumblers/cru-stemless-wine-glass-set-with-silicone-protection.
Aladdin Water Bottle (1 page).
https://www.elloproducts.com/water-bottles/elsie-22oz-glass-water-bottle.
https://www.elloproducts.com/tumblers/beacon-24oz-vacuum-insulated-stainless-tumbler.
https://www.elloproducts.com/kids/rise-12oz-vacuum-insulated-stainless-steel-tumbler.
https://www.elloproducts.com/travel-mugs/hammertime-18oz-vacuum-insulated-stainless-steel-travel-mug.
https://www.elloproducts.com/water-bottles/pure-20oz-glass-water-bottle.
https://www.elloproducts.com/kids/max-12oz-vacuum-insulated-stainless-steel-kids-water-bottle.
https://www.elloproducts.com/water-bottles/syndicate-20oz-glass-water-bottle.
Mason Glass Jar (1 page).
https://www.camelbak.com/en/bottles/R02056—Eddy_75L_2019?color=6bbd0584f3a64b0eb30d406ffe03797e.
https://www.gocontigo.com/20-oz-autoseal-west-loop-stainless-travel-mug-with-easy-clean-lid.html.
https://www.gocontigo.com/14-oz-autospout-striker-kids-water-bottle.html.
https://www.zojirushi.com/app/product/smyae.
https://www.zojirushi.com/app/product/smkc.
https://www.zojirushi.com/app/product/sjjs.
https://www.zojirushi.com/app/product/smqhe.
https://www.zojirushi.com/app/product/smtae.
https://www.zojirushi.com/app/product/smta.
https://www.zojirushi.com/app/product/smse.
https://www.zojirushi.com/app/product/smsd.
https://www.zojirushi.com/app/product/smshe.
https://www.zojirushi.com/app/product/smkhe.
https://www.zojirushi.com/app/product/smsc.
https://www.zojirushi.com/app/product/smpc.
https://www.zojirushi.com/app/product/smpb.
https://www.pinterest.ru/pin/12666442685646757/.
https://www.coleman.com/all-camp-kitchen/drinkware/switch-ss/col_2038485pr/COL_2038485.
https://corkcicle.com/products/classic-arctican?variant=475182759951.
Ello Reflext Beverage Container (1 page).

* cited by examiner 16
39
38
40
10
44
42
46
48
14
22
50
58
32
68
58
26
54
18
70
62
63
SLIDE LID OPEN
TIFT LEVER TO CLEAN
52
60
63
56

FIG. 8
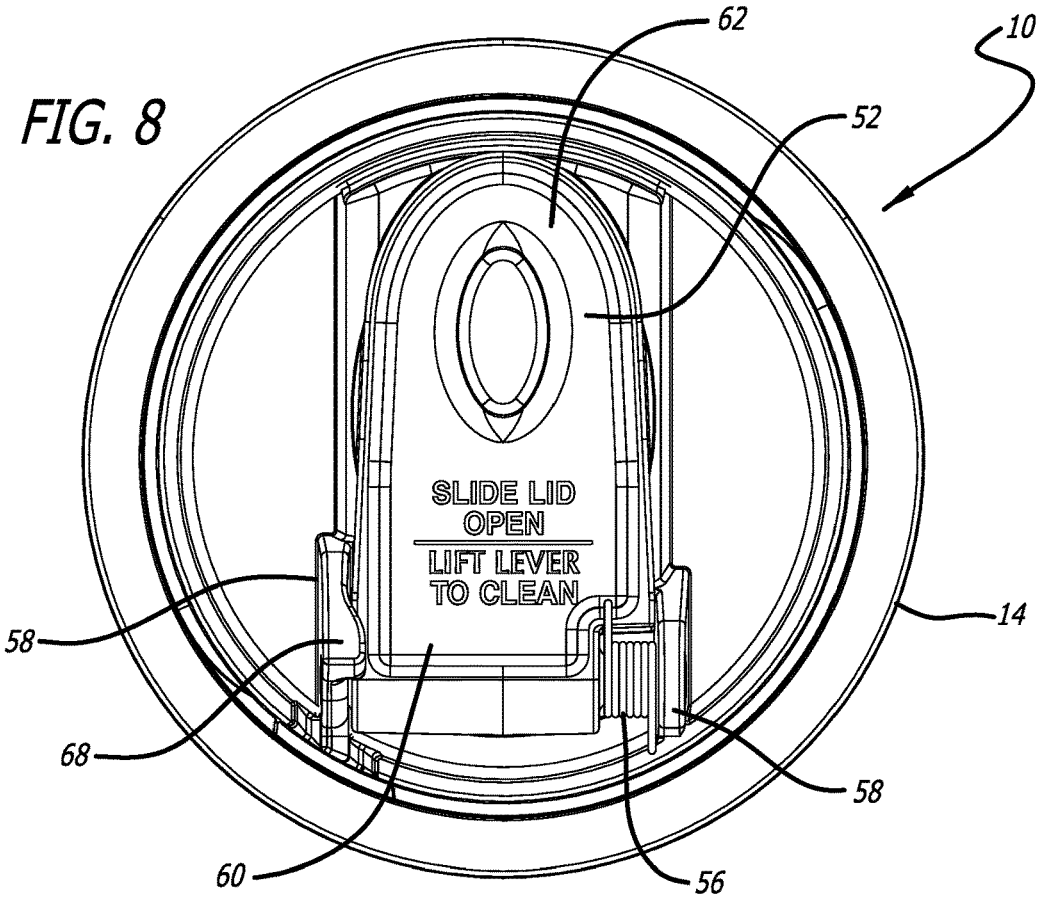
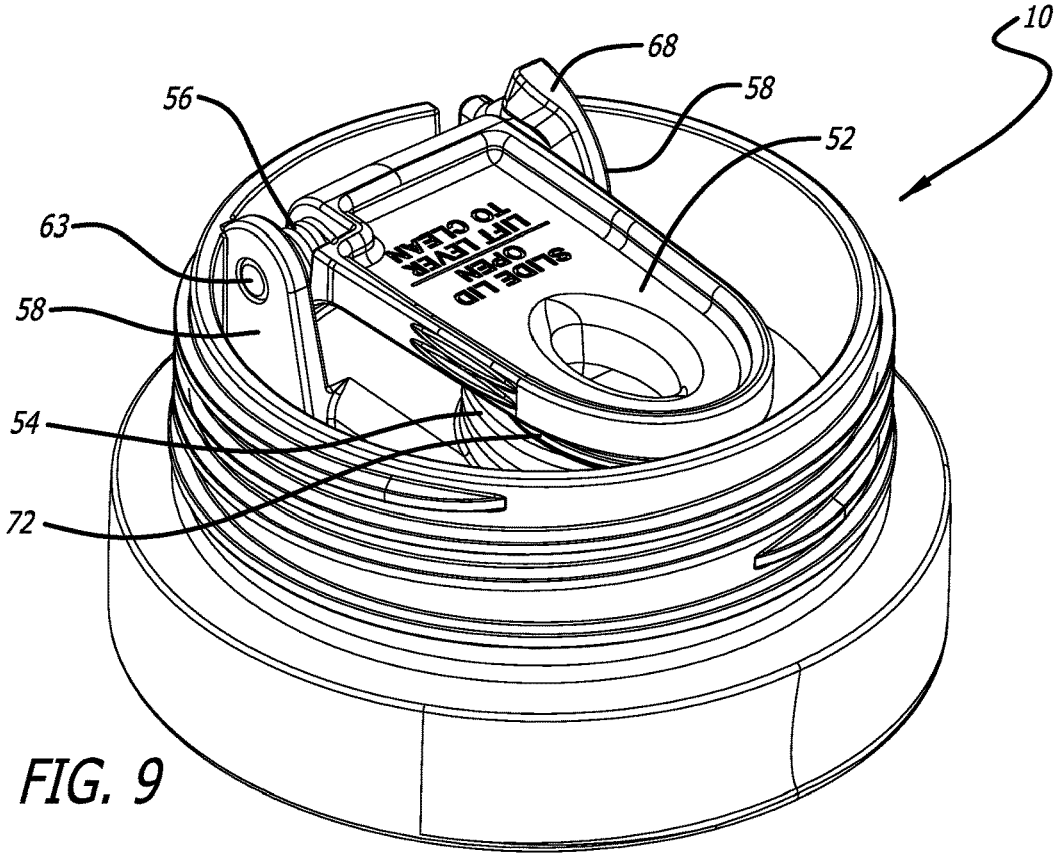
FIG. 9

SLIDER LID FOR BEVERAGE CONTAINER

FEDERALLY SPONSORED RESEARCH OR DEVELOPMENT

Not Applicable.

TECHNICAL FIELD

The present disclosure relates generally to lids for beverage containers, and more specifically to a cleanable lid having a sealable closure.

BACKGROUND

Beverage containers and lids for beverage containers are well known in the art. While such beverage containers and lids according to the prior art provide a number of advantages, they nevertheless have certain limitations. The present disclosure seeks to overcome certain of those limitations and other drawbacks of the prior art, and to provide new features not heretofore available. A full discussion of the features and advantages of the present disclosure is deferred to the following detailed description, which proceeds with reference to the accompanying drawings.

SUMMARY

According to certain aspects of the present disclosure, the disclosed subject technology generally relates to a lid for a beverage container.

The disclosed subject technology further relates to a lid assembly for a beverage container, comprising: a lid housing having a drink opening; a slider member slidingly connected to a first side of the lid housing, the slider member moving from a first position wherein the drink opening is accessible, to a second position wherein the drink opening is covered, and wherein the slider member does not closingly seal the drink opening in the second position; a cam pivotally connected to the slider member; and, a seal assembly pivotally connected to the lid housing, the seal assembly movable between an operable position and a cleaning position, the seal assembly having a seal arm that operates to assist in closing the drink opening in the operable position, wherein the seal arm is positioned away from the drink opening and unable to assist in closing the drink opening in the cleaning position, the seal arm being connected to the lid housing in the operable position and the cleaning position, wherein the slider member and cam operate to move the seal arm from an open position to a sealed position when the seal assembly is in the operable position to open and close the drink opening.

The disclosed subject technology further relates to a lid for a beverage container, comprising: a lid housing having a drink opening; a slider member slidingly connected to a first side of the lid housing, the slider member moving linearly from a first position to a second position in a plane substantially perpendicular to a longitudinal axis of the beverage container; a cam pivotally connected to the slider member; and, a seal assembly having a seal arm having a first end and a second end, the first end of the seal arm being pivotally connected adjacent a second side of the lid housing, a seal connected to the second end of the seal arm, and a spring, wherein the slider member and cam operate to move the seal arm from an open position to a sealed position, wherein the drink opening is open when the seal arm is in the open position, wherein the drink opening is closed by the seal when the seal arm is in the sealed position, and wherein the spring exerts a force on the seal arm towards the sealed position.

The disclosed subject technology further relates to a lid for a beverage container, comprising: a lid housing having a first outer side and a second inner side, a drink opening extending through the lid housing from the first outer side to the second inner side, and a plurality of tabs extending from the second inner side of the lid housing; a slider member slidingly connected to a first side of the lid housing, the slider member moving linearly from a first position to a second position; a cam pivotally connected to the slider member, the cam extending through a cam opening in the lid housing; and, a seal assembly having a seal arm, a seal and a spring, the seal arm having a first end and a second end, the first end of the seal arm being pivotally connected to the plurality of tabs of the lid housing, and the seal connected to the second end of the seal arm, wherein the slider member and cam operate to move the seal arm from an open position to a sealed position, wherein the drink opening is open when the seal arm is in the open position, wherein the drink opening is closed by the seal when the seal arm is in the sealed position, and wherein the spring exerts a force on the seal arm towards the sealed position.

The disclosed subject technology further relates to a lid for a beverage container, wherein the seal arm has a first end and a second end, the first end of the seal arm being pivotally connected adjacent a second side of the lid housing opposing the first side, the seal being connected to the second end of the seal arm.

The disclosed subject technology further relates to a lid for a beverage container, wherein a cam engages the seal arm adjacent the second end thereof.

The disclosed subject technology further relates to a lid for a beverage container, having a pair of tabs extending from the lid housing, the seal arm being pivotally connected to the tabs. In one embodiment, one of the tabs has a protrusion to retain the seal arm in the cleaning position.

The disclosed subject technology further relates to a lid for a beverage container, having a spring exerting a force on the seal arm to force the seal arm to the operable position.

The disclosed subject technology further relates to a lid for a beverage container, wherein the slider member moves linearly from a first position to a second position in a plane substantially perpendicular to a longitudinal axis of the beverage container.

The disclosed subject technology further relates to a lid for a beverage container, wherein the slider member moves from the first position wherein the drink opening is accessible, to the second position wherein the drink opening is covered, and wherein the slider member does not closingly seal the drink opening in the second position.

The disclosed subject technology further relates to a lid for a beverage container, wherein the slider member has legs that slidingly engage a slot in the housing.

The disclosed subject technology further relates to a lid for a beverage container, wherein linear movement of the slider member causes pivotal movement of the seal assembly.

The disclosed subject technology further relates to a lid for a beverage container, wherein the seal assembly is movable between an operable position and a cleaning position.

The disclosed subject technology further relates to a lid for a beverage container, wherein the seal arm has a cam surface adjacent the second end of the seal arm, wherein the cam surface is engaged by the cam.

The disclosed subject technology further relates to a lid for a beverage container, wherein the cam extends through a cam opening in the lid housing.

The disclosed subject technology further relates to a lid for a beverage container, wherein the seal engages the lid around the drink opening and the cam.

The disclosed subject technology further relates to a lid for a beverage container, wherein the seal also closes the cam opening when the seal arm is in the sealed position.

It is understood that other configurations and embodiments of the subject technology will become readily apparent to those skilled in the art from the following detailed description, wherein various configurations of the subject technology are shown and described by way of illustration. As will be realized, the subject technology is capable of other and different configurations, and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

To understand the present disclosure, it will now be described by way of example, with reference to the accompanying drawings in which embodiments of the disclosures are illustrated and, together with the descriptions below are incorporated in and constitute a part of this specification, and serve to explain the principles of the disclosure. In the drawings:

FIG. 8 illustrates a bottom view of the lid of FIG. 2, with the seal arm in the closed position.

FIG. 9 illustrates a bottom perspective view of the lid of FIG. 2, with the seal arm in the closed position.

Figure 1:
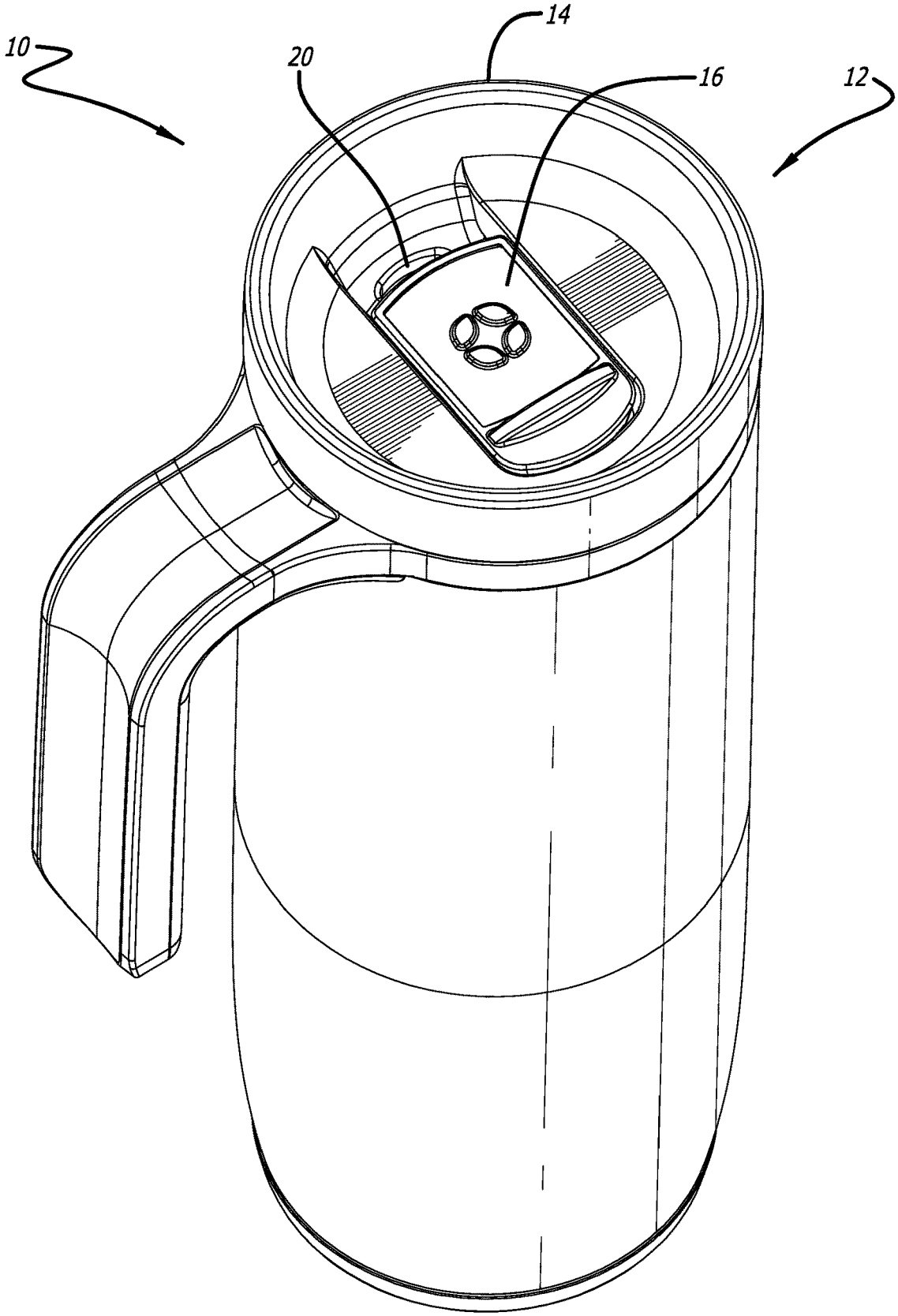
FIG. 1 illustrates a top perspective view of a beverage container having a sealing slider mechanism according to one embodiment.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

While the beverage container lid discussed herein is susceptible of embodiments in many different forms, there is shown in the drawings, and will herein be described in detail, preferred embodiments with the understanding that the present description is to be considered as an exemplification of the principles of the wagon and foldable trailer and are not intended to limit the broad aspects of the disclosure to the embodiments illustrated. Thus, the detailed description set forth below is not intended to represent the only implementations in which the subject technology may be practiced. As those skilled in the art would realize, the described implementations may be modified in various different ways, all without departing from the scope of the present disclosure. Accordingly, the drawings and description are to be regarded as illustrative in nature and not restrictive.

Referring now to the figures, and initially to FIGS. 1-4, a lid 10 for a beverage container 12 is illustrated. In various embodiments, the lid 10 comprises a lid housing 14, a slider member 16, and a seal assembly 18. Movement of the slider member 16 operates to transition the seal assembly 18 to open and close a drink opening 20 of the lid housing 14.

In one embodiment the lid housing 14 has threads 22, as shown in FIGS. 4-7 that engage with mating threads 24 on the inside of the beverage container 12 to secure the lid housing 14 to the beverage container 12. A gasket 26 is also provided between the lid housing 14 and the beverage container 12 to provide a seal between the lid housing 12 and the beverage container 12 so that the contents within a cavity 28 of the beverage container 12 do not leak out at the joint between the lid housing 14 and the beverage container 12. The lid housing 14 also preferably has a first outer side 30, also referred to as a first side 30, and an opposing second inner side 32, also referred to as a second side 32, as shown in FIGS. 2 and 3. The drink opening 20 extends through the lid housing 14 from the first outer side 30 to the second inner side 32

Figure 5:
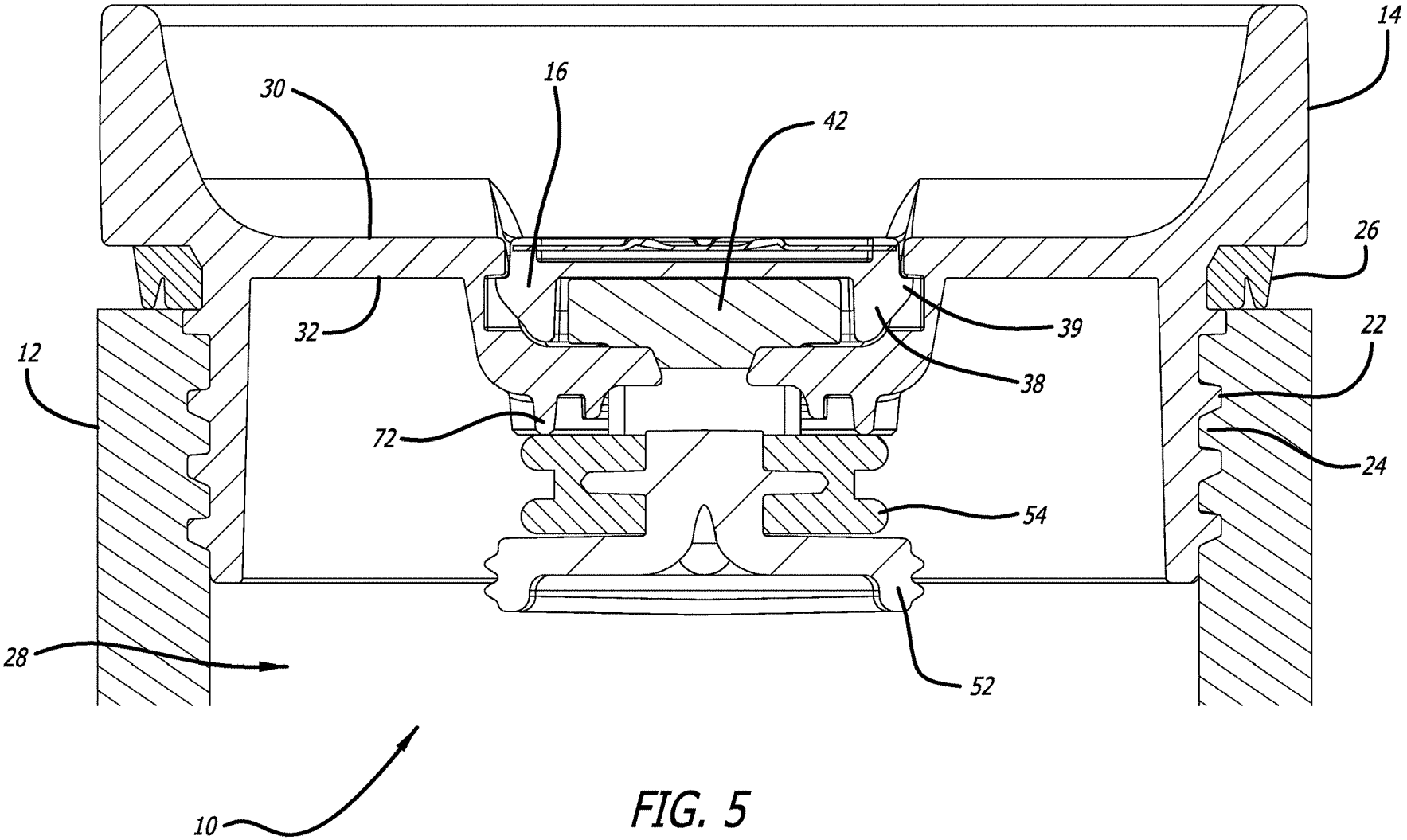
FIG. 5 illustrates a cross-sectional view of the lid about line 5-5 of FIG. 2.

The first side 30 of the lid housing 14 preferably has a recess 34 for receiving the slider member 16. To allow the slider member 16 to slide linearly within the recess 34, the lid housing 14 preferably has slots 36 in the sidewalls of the recess 34. The slots 36 receive legs 38 extending from the sidewalls of the slider member 16 as shown in FIGS. 3 and 5, and the legs 38 can traverse linearly in a sliding manner in the slots 36. The legs 38 also have ears 39 that lock the legs 38, and thus the slider member 16, within the slot 36 and to the lid housing 14. Accordingly, the slider member 16 is slidingly connected to the first side 30 of the lid housing 14.

Figure 2A:
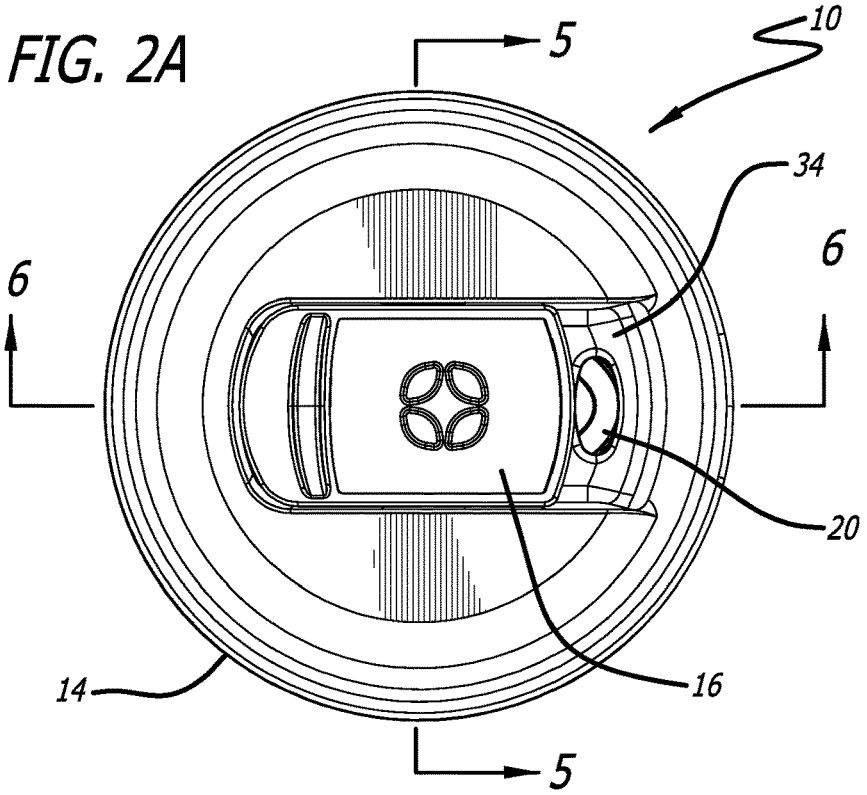
FIG. 2A illustrates a top view of the lid of FIG. 1 with the slider member in the first or open position.
Figure 2B:
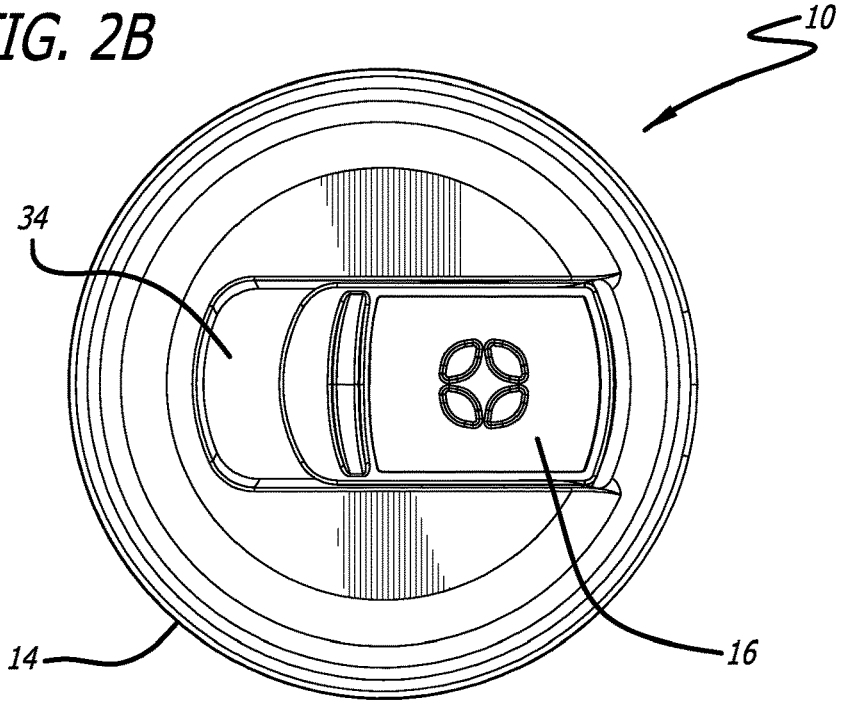
FIG. 2B illustrates a top view of the lid of FIG. 1 with the slider member in the second or closed position.
Figure 3:
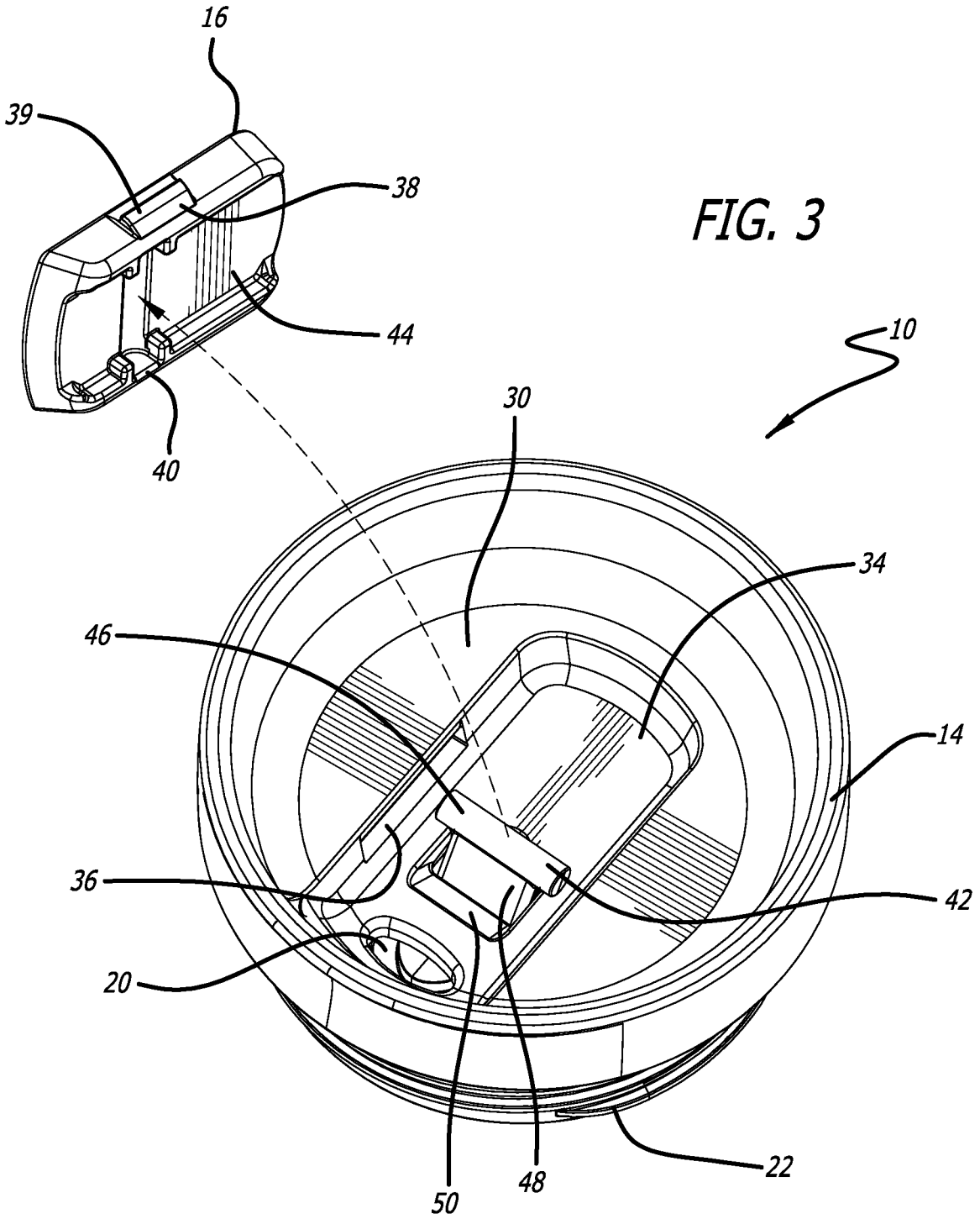
FIG. 3 illustrates a top perspective view of the lid of FIG. 2 with the slider exploded off the lid body.
Figure 4:
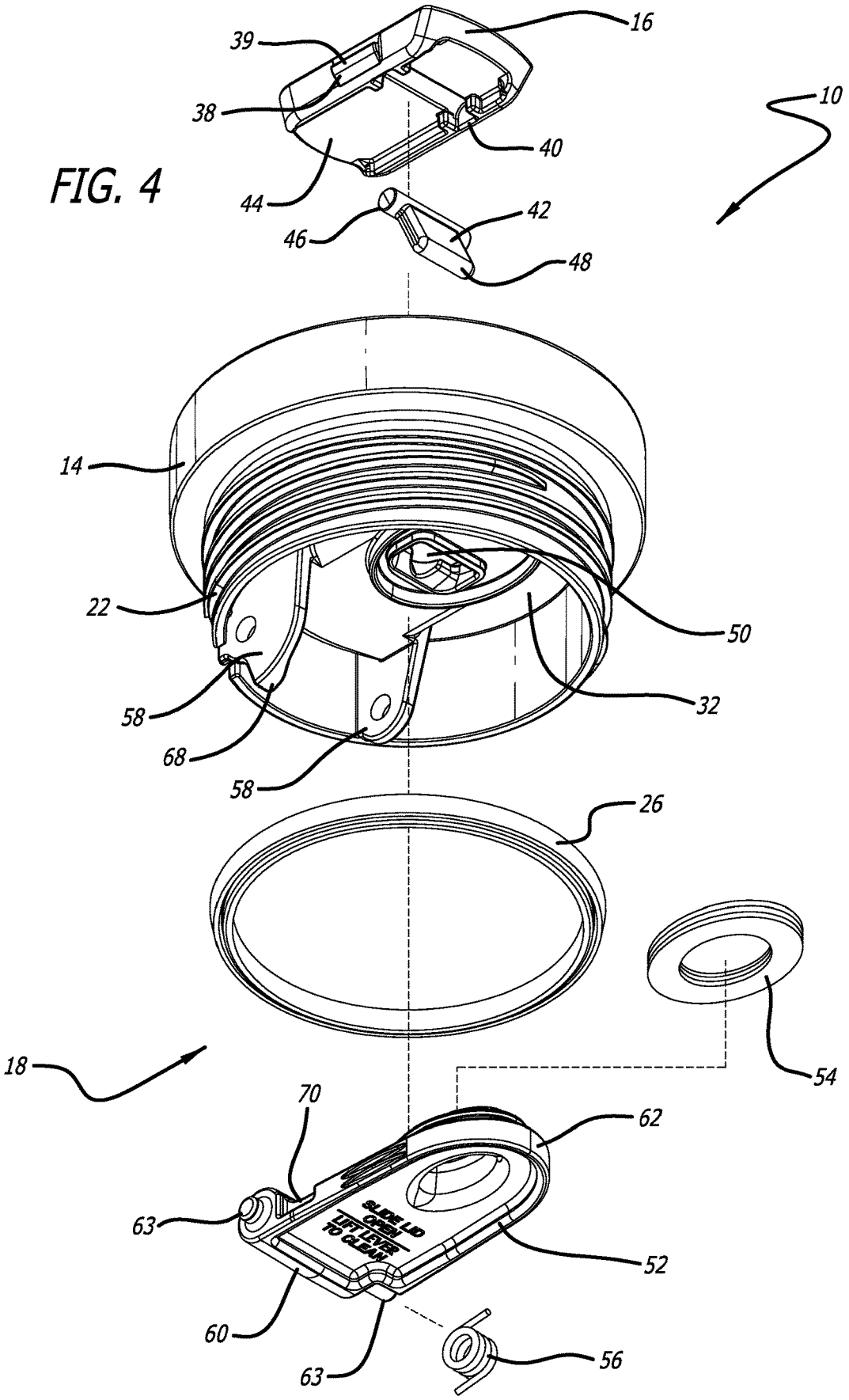
FIG. 4 illustrates an exploded perspective view of the lid of FIG. 2.
Figure 6:
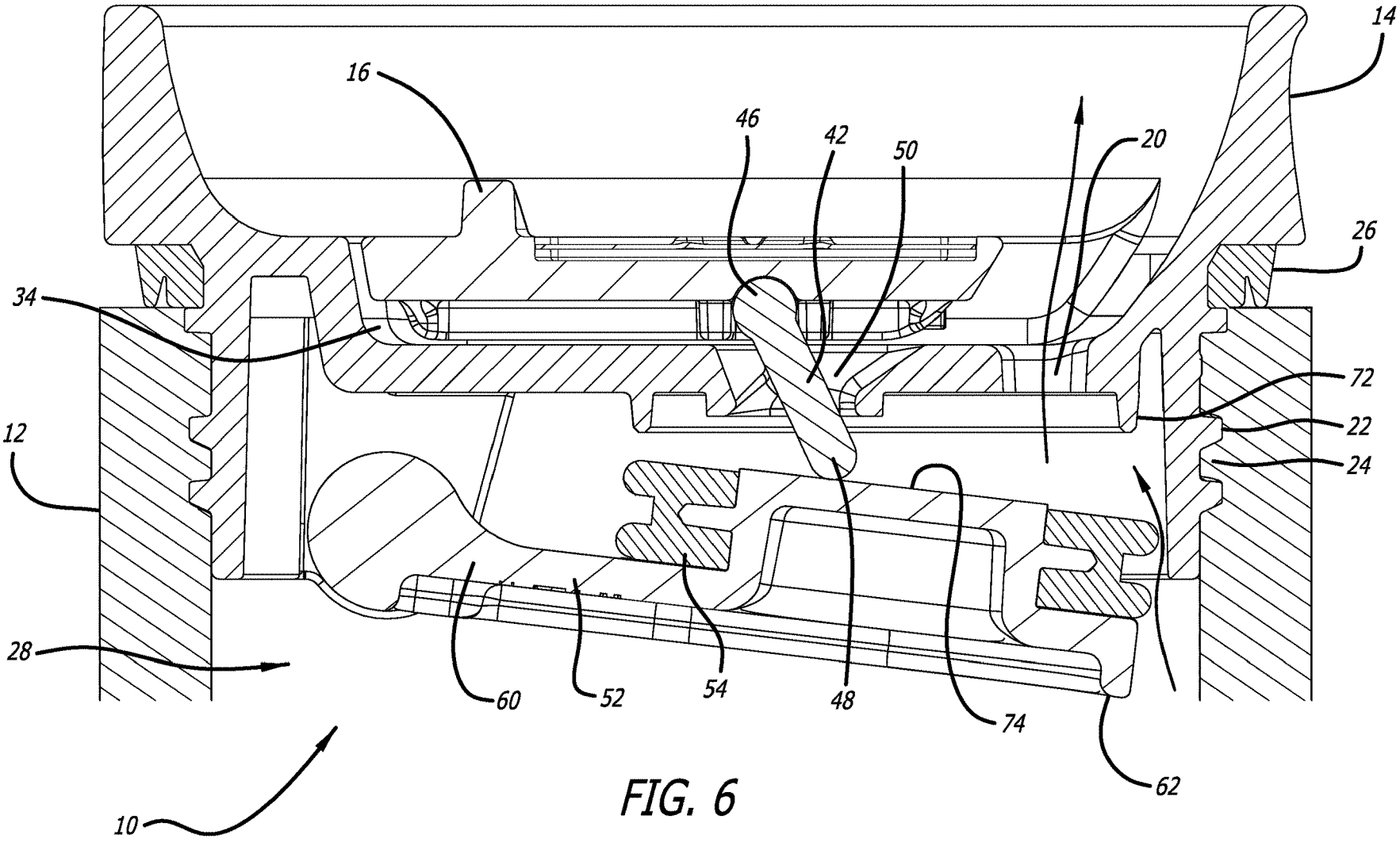
FIG. 6 illustrates a cross-sectional view of the lid about line 6-6 of FIG. 2, with the seal arm in the open position.
Figure 7:
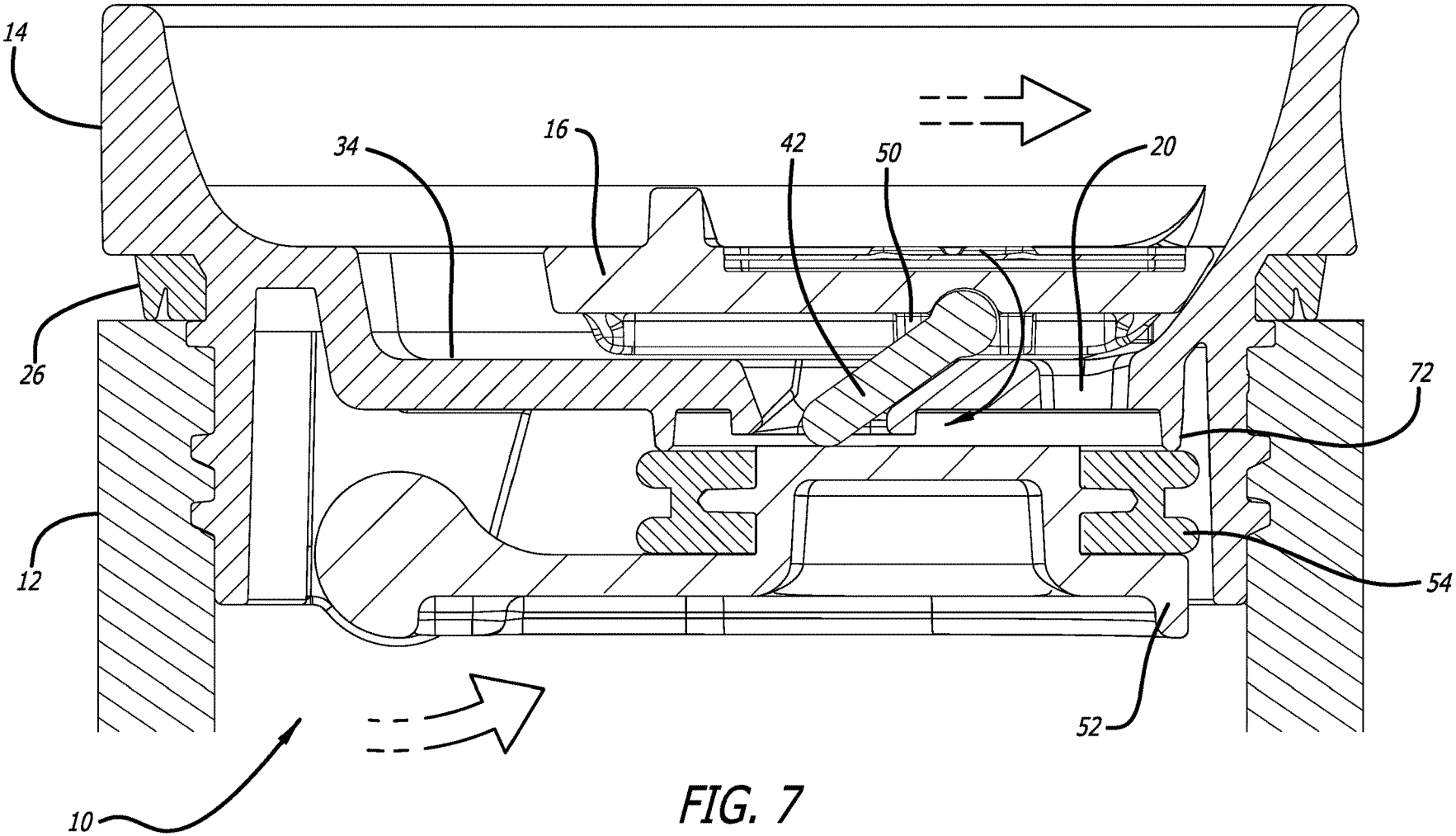
FIG. 7 illustrates a cross-sectional view of the lid about line 6-6 of FIG. 2, with the seal arm in the closed position.

As shown in FIGS. 2A and 2B, when the seal assembly 18 is in the operable position, the slider member 16 moves from a first position where the drink opening 20 is accessible and where the seal assembly 18 is in the open position (FIG. 2A and FIG. 6), to a second position where the drink opening 20 is covered by the slider member 16 and the seal assembly 18 is in the closed position (FIG. 2A and FIG. 7). Additionally, as seen in the drawings, especially at FIGS. 2A, 2B, 6 and 7, in a preferred embodiment the slider member 16 moves linearly in a sliding manner from the first position to the second position in a plane substantially perpendicular to a longitudinal axis of the beverage container 12. In one embodiment, the slider member 16 itself does not closingly seal the drink opening 20 in the second position of the slider member 16 (i.e., in the position shown in FIG. 2B), rather the seal 54 of the seal arm 52 closingly seals the drink opening 20.

In one embodiment, the slider member 16 has a receiver 40 for pivotally receiving a cam 42. The receiver 40 is preferably on the bottom side 44 of the slider member 16. The cam 42 is used to help move the seal assembly 18 between an operable position (shown in FIGS. 6-9) and a cleaning position (shown in FIGS. 10 and 11). In one embodiment the cam 42 is pivotally connected to the slider member 16 within the receiver 40 of the slider member 16. Referring to FIGS. 3-4 and 6-7, in one embodiment the cam 42 comprises a pivot shaft 46 and a cam extension 48. The pivot shaft 46 portion of the cam 42 allows the cam 42 to pivot within the receiver 40 of the slider member 16. And, the cam extension 48 of the cam 42 allows the cam 42 to engage the seal assembly 18 when the seal assembly 18 is in the operable position.

As shown in FIGS. 3-4, 6-7 and 10, the lid housing 14 has a cam opening 50 to allow the cam 42 to pass through the lid housing 14 to engage the seal assembly 18. Referring to the figures, the cam opening 50 extends through the lid housing 14 from the first outer side 30 to the second inner side 32 to allow the cam 42 to pass therethrough.

Figure 10:
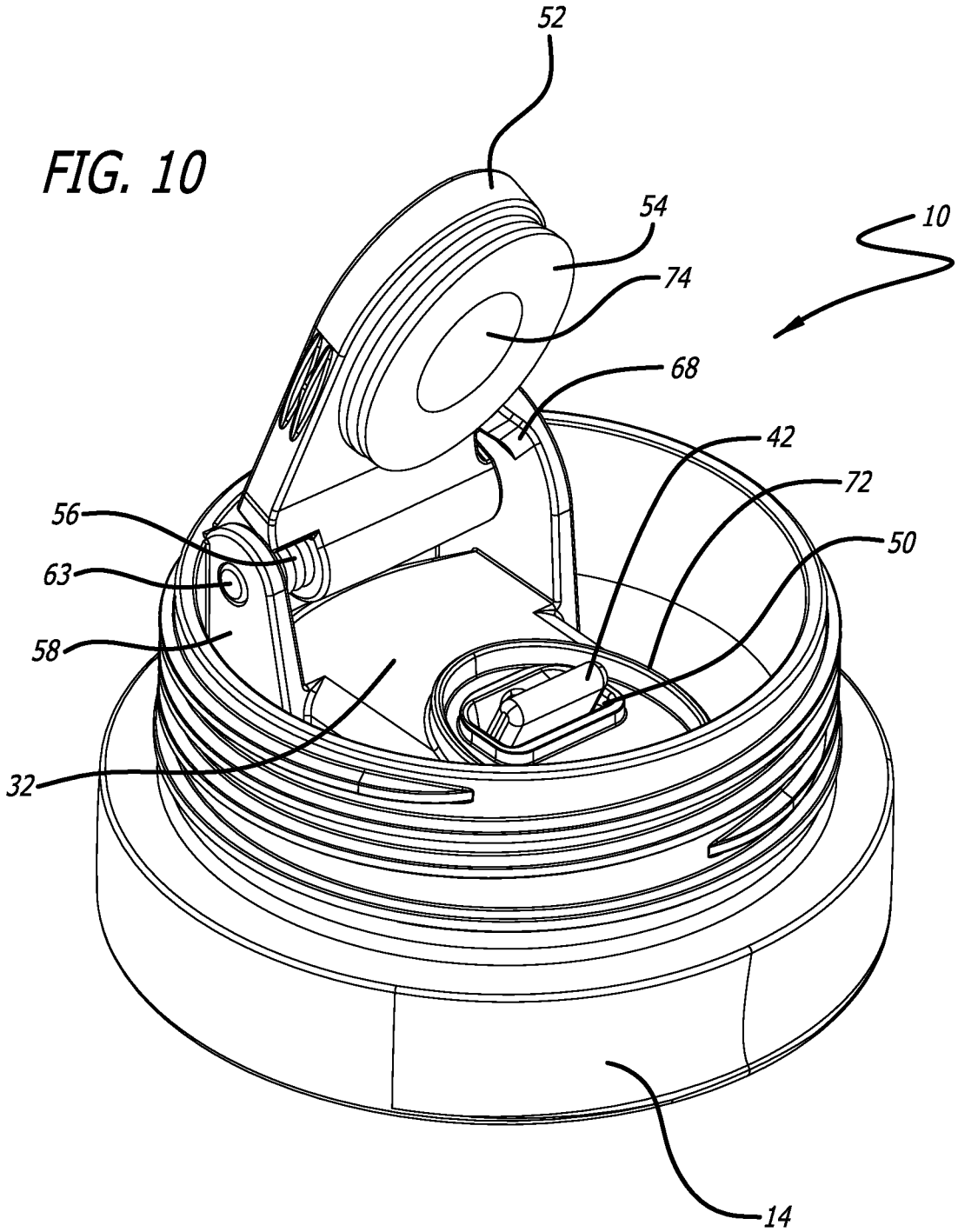
FIG. 10 illustrates a bottom perspective view of the lid of FIG. 2, with the seal arm in the cleaning position.
Figure 11:
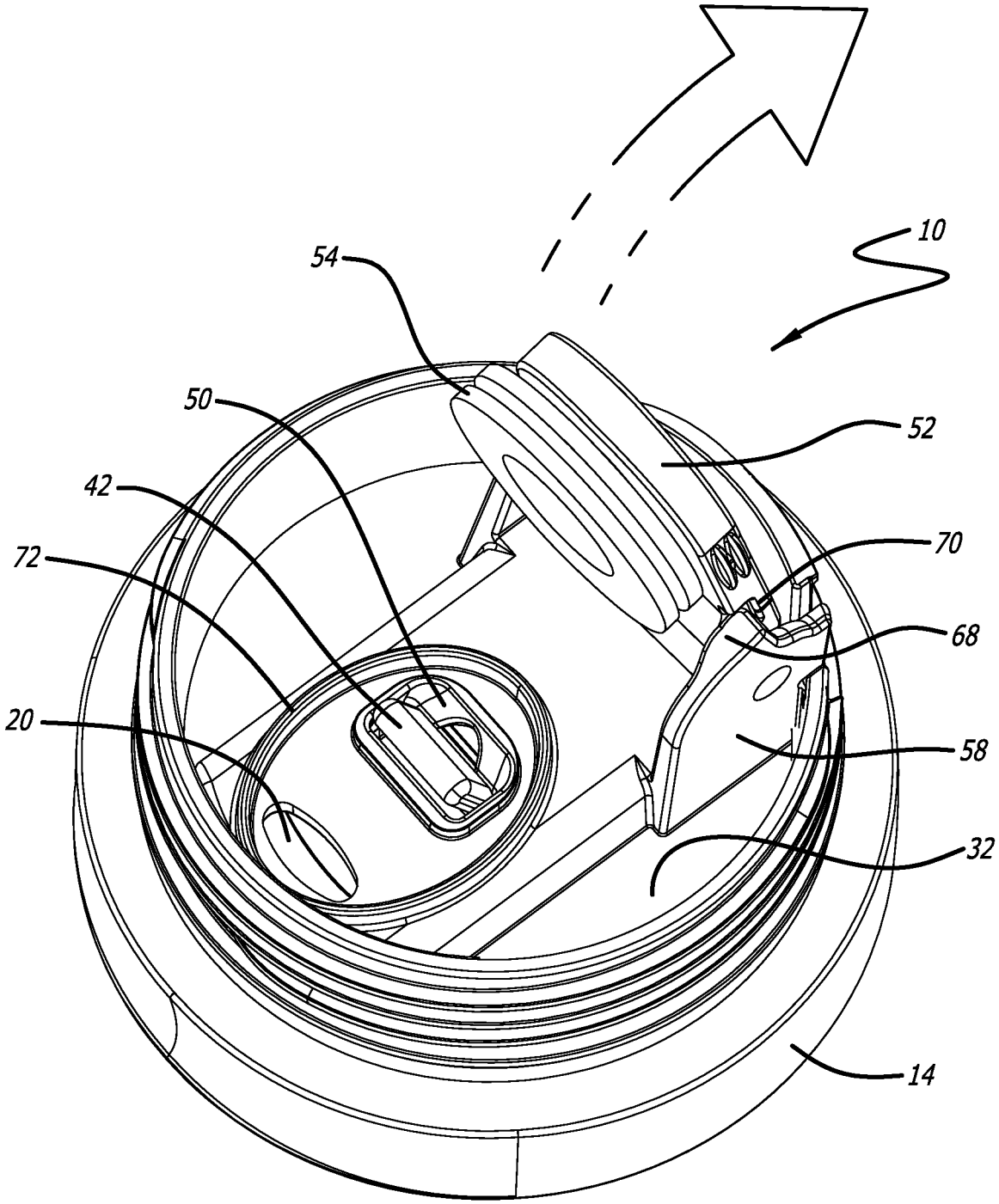
FIG. 11 illustrates a bottom perspective view of the lid of FIG. 2, with the seal arm in the cleaning position.

As explained above, the lid assembly 10 has a seal assembly 18. In one embodiment, the seal assembly 18 generally comprises a seal arm 52, a seal 54, and a spring 56. The seal assembly 18 is preferably pivotally connected to the lid housing 14, and pivotally moveable between an operable position and a cleaning position. Preferably, the seal arm 52 is connected to the lid housing 14 in both the operable position and the cleaning position. In one embodiment, a plurality of tabs 58 extend from the lid housing 14, and preferably the second inner side 32 of the lid housing 14. The seal assembly 18 may be pivotally attached to the tabs 58 of the lid housing 14. The seal arm 52 operates to assist in closing the drink opening 20 when the seal assembly 18 is in the operable position as shown in FIGS. 7-9. However, when the seal assembly 18 is in the cleaning position, as shown in FIGS. 10 and 11, the seal arm 52 is positioned away from the drink opening 20 and is unable to assist in closing the drink opening 20. Further, the slider member 16 and cam 42 do not contact the seal assembly 18 when the seal assembly 18 is in the cleaning position as shown in FIGS. 10 and 11.

The seal arm 52 has a first end 60 and a second end 62. Referring to FIGS. 4 and 9-11, in one embodiment the seal 54 is connected to the second end 62 of the seal arm 52. And in one embodiment, the first end 60 of the seal arm 52 is pivotally connected to the tabs 58 extending from the lid housing 14 adjacent the second side 32 of the lid housing 14. As shown in those figures, the seal arm 52 may have pivot extensions 63 extending from the first end 60 that engage pivot openings 64 in the tabs 58. The spring 56 is seated on one of the pivot extensions 63 of the seal arm 52. The spring 56 exerts a force on the seal arm 52 toward the sealed position to have the seal 54 at the second end 62 of the seal arm 52 close the drink opening 20.

In one embodiment, as shown in FIGS. 4 and 8-11, one of the tabs 58 has a protrusion 68 and the seal arm 52 has a depression 70. Engagement of the protrusion 68 in the depression 70 operates to retain the seal arm 52 in the cleaning position (as shown in FIGS. 10 and 11), against the spring force of the spring 56. To move the seal arm 52 from the operable position to the cleaning position the user pivots the seal arm 52 back away from the drink opening 20 against the force of the spring 56. This can be done when the seal arm 52 is in the closed or open position. When the seal arm 52 is rotated away from the drink opening 20 a sufficient distance, the protrusion 68 of the tab 58 will engage the depression 70 and the engagement of the protrusion 68 in the depression 70 will retain the seal arm 52 in the cleaning position as shown in FIGS. 10 and 11. In the cleaning position the drink opening 20 and the cam opening 50 are accessible. To place the seal arm 52 once again in the operable position the user needs only to slightly push the seal arm 52 back toward the drink opening 20 to disengage the protrusion 68 from the depression 70, and the force of the spring 56 will assist in moving the seal arm 52 back to the operable position.

Referring to FIGS. 4, 6-7 and 10, a seal ring 72 is provided on the second side 32 of the lid housing 14. In the sealed position of the seal arm 52 (FIG. 7), the seal 54 on the seal arm 52 engages and provides a seal against the seal ring 72 to close off everything within the seal ring 72, including the drink opening 20 and the cam opening 50, from the contents within the cavity 28 of the beverage container 12.

In operation, when the seal assembly 18 is in the operable position, the slider member 16 and cam 42 operate to move the seal arm 52 from the open position (FIG. 6) where the seal 54 is positioned a distance from the drink opening 20 so that the drink opening 20 is open and the liquid contents within the cavity 28 of the beverage container 12 can be expelled through the drink opening 20, to the sealed or closed position (FIG. 7) when the seal 54 engages the seal ring 72 to close the drink opening 20.

As explained herein, when the slider member 16 is in the first position, as shown in FIG. 2A, the drink opening 20 is accessible and the seal assembly 18 is in the open position as shown in FIG. 6. Specifically, while the spring 56 exerts a force on the seal arm 52 toward the sealed position to have the seal 54 at the second end 62 of the seal arm 52 close the drink opening 20, when the slider member 16 is in the first position the cam 42 engages and exerts a force on a cam surface 74 of the seal arm 52 adjacent a second end 62 of the seal arm 52 to push the seal arm 52 and seal 54 away from the drink opening 20 to keep the drink opening 20 open so that liquid can pass through the drink opening 20.

To move the seal arm 52 from the open position to the closed or sealed position to close the drink opening 20, the user must slide the slider member 16 linearly from the first position to the second position, as shown in FIG. 2B. In the second position the slider member 16 covers the drink opening 20, but preferably the slider member 16 itself does not closingly seal the drink opening 20—the seal 54 seals the drink opening 20. When the slider member 16 is slid to the second position, as shown in FIG. 7, the cam 42 pivots within the receiver 40 of the slider member 16 about the pivot shaft 46 portion of the cam 42. The spring 56 continues to exert a force on the seal arm 52 toward the sealed position and when the cam 42 transitions to its pivoted position out of the way of the seal arm 52 the seal 54 can be seated on seal ring 72 to provide a seal against the seal ring 72 to close off everything within the seal ring 72, including the drink opening 20 and the cam opening 50, from the contents within the cavity 28 of the beverage container 12. Finally, if the slider member 16 is slid linearly back from the second position to the first position, the cam 42 will pivot downward toward the seal arm 52 to pivot the seal arm 52 and the seal 54 away from the drink opening 20 as shown in FIG. 6. Thus, linear motion of the slider member 16 causes pivotal movement of the seal assembly 18, via the cam 42, both when moving the slider member 16 from the first to the second position, and from the second position to the first position.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number. Additionally, the term "having" as used herein in both the disclosure and claims, is utilized in an open-ended manner.

As used herein, the phrase "at least one of" preceding a series of items, with the terms "and" or "or" to separate any of the items, modifies the list as a whole, rather than each member of the list (i.e., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

To the extent that the term "include," "have," or the like is used in the description or the claims, such term is intended to be inclusive in a manner similar to the term "comprise" as "comprise" is interpreted when employed as a transitional word in a claim. Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. Relational terms such as first and second and the like may be used to distinguish one entity or action from another without necessarily requiring or implying any actual such relationship or order between such entities or actions. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description. No claim element is to be construed under the provisions of 35 U.S.C. § 112, sixth paragraph, unless the element is expressly recited using the phrase "means for" or, in the case of a method claim, the element is recited using the phrase "step for."

While this specification contains many specifics, these should not be construed as limitations on the scope of what may be claimed, but rather as descriptions of particular implementations of the subject matter. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention and the scope of protection is only limited by the scope of the accompanying Claims.

Further, the claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

What is claimed is:

1. A lid for a beverage container, comprising:

a lid housing having a drink opening;

a slider member slidingly connected to a first side of the lid housing, the slider member moving from a first position wherein the drink opening is accessible, to a second position wherein the drink opening is covered, and wherein the slider member does not closingly seal the drink opening in the second position;

a cam pivotally connected to the slider member; and, a seal assembly pivotally connected to the lid housing, the seal assembly movable between an operable position and a cleaning position, the seal assembly having a seal arm that operates to assist in closing the drink opening in the operable position, wherein the seal arm is positioned away from the drink opening and unable to assist in closing the drink opening in the cleaning position, the seal arm being connected to the lid housing in the operable position and the cleaning position, wherein the slider member and cam operate to move the seal arm from an open position to a sealed position when the seal assembly is in the operable position to open and close the drink opening.

2. The lid of claim 1, wherein the seal arm has a first end and a second end, the first end of the seal arm being pivotally connected adjacent a second side of the lid housing opposing the first side, the seal being connected to the second end of the seal arm.

3. The lid of claim 2, wherein the cam engages the seal arm adjacent the second end thereof.

4. The lid of claim 2, further comprising a pair of tabs extending from the lid housing, the seal arm being pivotally connected to the tabs.

5. The lid of claim 4, wherein one of the tabs has a protrusion to retain the seal arm in the cleaning position.

6. The lid of claim 1, further comprising a spring exerting a force on the seal arm to force the seal arm to the operable position.

7. The lid of claim 1, wherein the slider member moves linearly from a first position to a second position in a plane substantially perpendicular to a longitudinal axis of the beverage container.

8. A lid for a beverage container, comprising:

a lid housing having a drink opening;

a slider member slidingly connected to a first side of the lid housing, the slider member moving linearly from a first position to a second position in a plane substantially perpendicular to a longitudinal axis of the beverage container;

a cam pivotally connected to the slider member; and, a seal assembly having a seal arm having a first end and a second end, the first end of the seal arm being pivotally connected adjacent a second side of the lid housing, a seal connected to the second end of the seal arm, and a spring, wherein the slider member and cam operate to move the seal arm from an open position to a sealed position, wherein the drink opening is open when the seal arm is in the open position, wherein the drink opening is closed by the seal when the seal arm is in the sealed position, and wherein the spring exerts a force on the seal arm towards the sealed position.

9. The lid of claim 8, wherein the slider member moves from the first position wherein the drink opening is accessible, to the second position wherein the drink opening is covered, and wherein the slider member does not closingly seal the drink opening in the second position.

10. The lid of claim 8, wherein the seal assembly is movable between an operable position and a cleaning position.

11. The lid of claim 10, further comprising a protrusion extending from the lid housing to retain the seal assembly in the cleaning position.

12. The lid of claim 8, wherein linear movement of the slider member causes pivotal movement of the seal assembly.

13. The lid of claim 8, wherein the seal arm has a cam surface adjacent the second end of the seal arm, wherein the cam surface is engaged by the cam.

14. The lid of claim 8, wherein the cam extends through a cam opening in the lid housing.

15. The lid of claim 8, wherein the seal engages the lid around the drink opening and the cam.

16. A lid for a beverage container, comprising:

a lid housing having a first outer side and a second inner side, a drink opening extending through the lid housing from the first outer side to the second inner side, and a plurality of tabs extending from the second inner side of the lid housing;

a slider member slidingly connected to a first side of the lid housing, the slider member moving linearly from a first position to a second position;

a cam pivotally connected to the slider member, the cam extending through a cam opening in the lid housing; and, a seal assembly having a seal arm, a seal and a spring, the seal arm having a first end and a second end, the first end of the seal arm being pivotally connected to the plurality of tabs of the lid housing, and the seal connected to the second end of the seal arm, wherein the slider member and cam operate to move the seal arm from an open position to a sealed position, wherein the drink opening is open when the seal arm is in the open position, wherein the drink opening is closed by the seal when the seal arm is in the sealed position, and wherein the spring exerts a force on the seal arm towards the sealed position.

17. The lid of claim 16, wherein the slider member slides in a plane substantially perpendicular to a longitudinal axis of the beverage container.

18. The lid of claim 16, wherein the slider member has legs that slidingly engage a slot in the housing.

19. The lid of claim 16, wherein the seal also closes the cam opening when the seal arm is in the sealed position.

20. The lid of claim 16, wherein the seal assembly is movable between an operable position and a cleaning position, and further comprising a protrusion extending from one of the plurality of tabs to retain the seal assembly in the cleaning position.

* * * * *